US005653631A

United States Patent [19]

Andersen et al.

[11] Patent Number: 5,653,631

[45] Date of Patent: Aug. 5, 1997

[54] INFINITELY ADJUSTABLE OFFSET VENT CONNECTOR

[75] Inventors: John L. Andersen, Jacksonville, Tex.; Charles R. Kenrick, Spring Lake, Mich.

[73] Assignee: Builder's Best Inc., Jacksonville, Tex.

[21] Appl. No.: 642,517

[22] Filed: May 3, 1996

[51] Int. Cl.[6] ..... F24F 7/00

[52] U.S. Cl. ..... 454/339; 34/235; 454/359

[58] Field of Search ..... 34/235; 454/337, 454/339, 341, 359; 285/67, 73, 79, 18, 330, 298, 302

[56] References Cited

U.S. PATENT DOCUMENTS

| | | | |
|---|---|---|---|
| 31,652 | 3/1861 | Bell | 126/82 |
| D. 218,825 | 9/1970 | Blummer | D23/1 |
| 258,311 | 5/1882 | Neilson | 126/82 |
| 317,353 | 5/1885 | Hayes | 198/562 |
| 323,317 | 7/1885 | Goodrich | 406/151 |
| 732,497 | 6/1903 | Amos | 285/325 |
| 831,429 | 9/1906 | Harington | 126/82 |
| 2,044,761 | 6/1936 | Becvar | 126/307 |
| 3,511,252 | 5/1970 | Kennedy | 134/145 |
| 5,257,468 | 11/1993 | Lebrun | 34/235 |

*Primary Examiner*—Henry A. Bennett
*Assistant Examiner*—Dinnatia Doster
*Attorney, Agent, or Firm*—Price, Heneveld, Cooper, DeWitt and Litton

[57] ABSTRACT

An extensible-contractible duct connector of slidingly interfittable, elongated, partial duct elements, the partial duct elements having an open end telescopically interfit with an open end of the other partial duct element to cooperatively form a duct connector, each having an outer closed end, each partial duct element having a side air flow opening directly adjacent the respective one of the closed ends to prevent significant dead air space between the opening and the adjacent closed end, the partial duct elements having slidably interfitting lateral edges with each other enabling sliding telescopic interfit that is incrementally variably adjustable between an extended condition with the side air flow openings offset maximally from each other, and a contracted condition with the side air flow openings having zero offset from each other.

20 Claims, 6 Drawing Sheets

INFINITELY ADJUSTABLE OFFSET VENT CONNECTOR

BACKGROUND OF THE INVENTION

This invention relates to air flow duct connectors as for use on clothes dryers and the like.

Air flow duct systems for venting exhaust air from clothes dryers must adapt to a variety of physical positions between the dryer air outlet and the opening in the adjacent wall. This is because each installation typically encounters a different lateral spacing between the outlet on the dryer and the opening in the wall. One duct component which is used to accommodate certain of these dimensional relationships is a telescopically expandable and contractible, two-piece tube assembly with side openings, sometimes called a "periscope" connector because of its visual resemblance to an actual optical periscope. This type of connector is advantageous in allowing the dryer to be located close to the wall, e.g., at about a two inch spacing. This type of connector is formed of two tubes which are telescopically interfitted, each having a lateral orifice and sleeve. There is a definite limit in the amount of contraction possible with these known commercial connectors because the sleeve abuts the end of the other tube. Thus, if the dryer outlet is displaced laterally only a few inches, or down to a fraction of an inch, from the wall opening, or even partially overlaps the wall opening, a periscope connector cannot normally be employed. Moreover, the dryer outlet is almost invariably somewhat offset from the wall opening. Therefore, connecting the dryer to the outlet with a proper metal connector meeting fire safety standards can present a significant problem. A typical type of telescopic connector is shown in U.S. Pat. No. Del. 218,825 to Blumer. Use of such a typical telescopic connector on a gas range is shown in U.S. Pat. No. 2,044,761 to Becvar. As will be noted, the minimum spacing between the air flow openings is a function of the maximum spacing of the openings.

What is needed in the trade is a telescopic air flow duct connector capable of having its inlet and outlet openings variably movable from a significantly wide spacing down to a small spacing and even a zero spacing, i.e., aligned with each other, so as to even accommodate any incremental spacing between these two extremes. Moreover, at all of these positions there must not be any significant dead air space adjacent the openings, or lint will collect there and present a potential fire hazard. Applicants are aware of stove pipe teachings as in Bell U.S. Pat. No. 31,652 (1861) and Neilson U.S. Pat. No. 258,311 (1882) which set forth special stove pipes potentially capable of a zero spacing at the openings, but these have significant resulting dead air spaces unsuitable for safe use with a clothes dryer because of the lint collection potential fire hazard.

SUMMARY OF THE INVENTION

An object of this invention is to provide a novel extensible/contractible air flow duct connector which is expandable to a maximum length of the two interfitting components, and infinitely contractible down to a zero offset of the two lateral air flow openings of the connector, yet having no significant dead air space adjacent the openings for lint to collect and present a potential fire danger, regardless of the relative adjusted positions of the lateral openings.

The connector is formed of two slidingly interfittable, elongated, partial duct elements having slidably interconnected lateral edges, each partial duct element having one closed end and a closely adjacent lateral air flow opening.

The term "partial duct" or "partial duct element" is intended to mean not peripherally enclosed. The partial duct elements can comprise one element having three sides and the other having one side, for example, or can each have two sides as another example. Preferably, the resulting connector is rectangular in cross section, having two wider sides and two narrower sides, the wider sides being opposite each other and the narrower sides being opposite each other. Other cross sectional configurations are also possible. The main features are telescopically interfit partial duct elements, each having a closed end and an air flow lateral opening closely adjacent the closed ends, as depicted.

These and other objects, advantages and features of the invention will become apparent upon studying the following specification in conjunction with the drawings.

DESCRIPTION OF THE PREFERRED EMBODIMENTS

First Embodiment

Figure 1A:
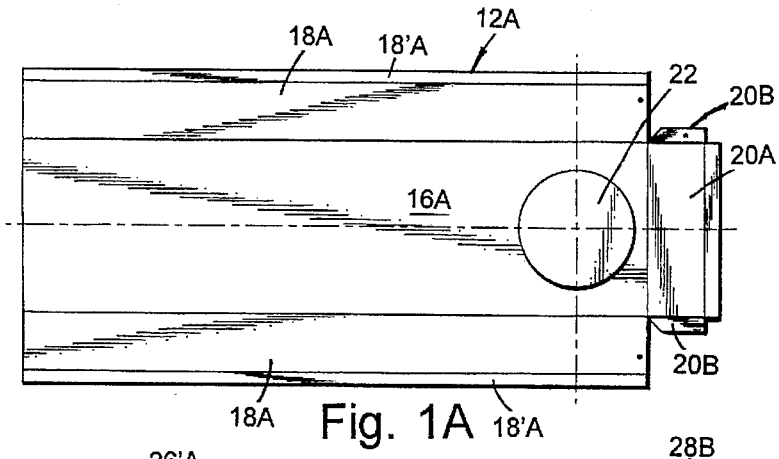
FIG. 1A is a plan view of a flat blank to form the upper component of the connector in FIG. 1.

Referring now to the drawings, and specifically to the first embodiment connector in FIGS. 1–7, this air flow duct connector 10 is shown to be composed of two components 12 and 14. In this embodiment, component 12 comprises an elongated partial duct element having three integrally connected walls, including a wider wall 16 and two oppositely positioned narrower walls 18 (FIG. 6) joined to and bent normal to the wider wall. The free edges of walls 18 have a doubled back, U-shaped configuration (FIGS. 6 and 7) which form a flange 18' and a groove 18", both parallel to adjacent walls 18. An integral end wall 20 (FIG. 1) is formed by a flange which is normal to the other walls, being bent normal to wall 16 and ending up normal to walls 18 also. Wall 20 doses this end of this partial duct element 12. Closely adjacent end wall 20, and in wall 16, is a circular opening 22 into which a cylindrical, open ended, swivel sleeve 24 is mounted so as to project laterally, normal, i.e., perpendicular, to wall 16, and be rotational with respect to wall 16 and therefore to connector component 12. This swivel connection may be formed by standard techniques such as crimped fitting of sleeve 24 to component 16 by techniques well known in the trade.

Figure 4:
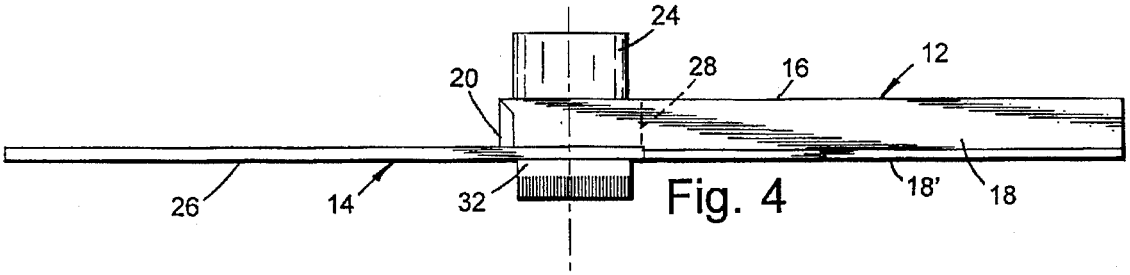
FIG. 4 is a side elevational view of the connector in FIG. 1, shown in its contracted condition.
Figure 5:
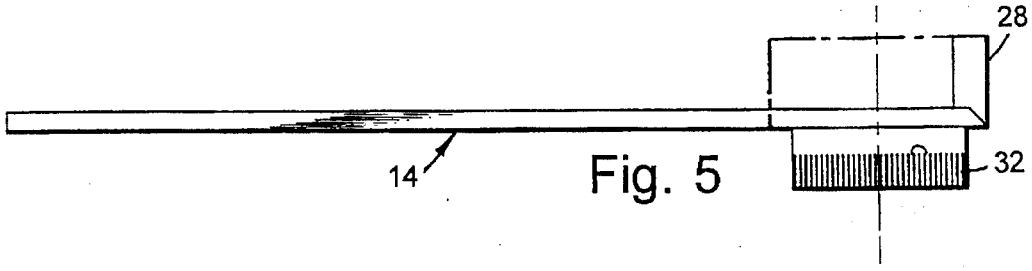
FIG. 5 is a side elevational view of the lower component in FIG. 1.
Figure 6:
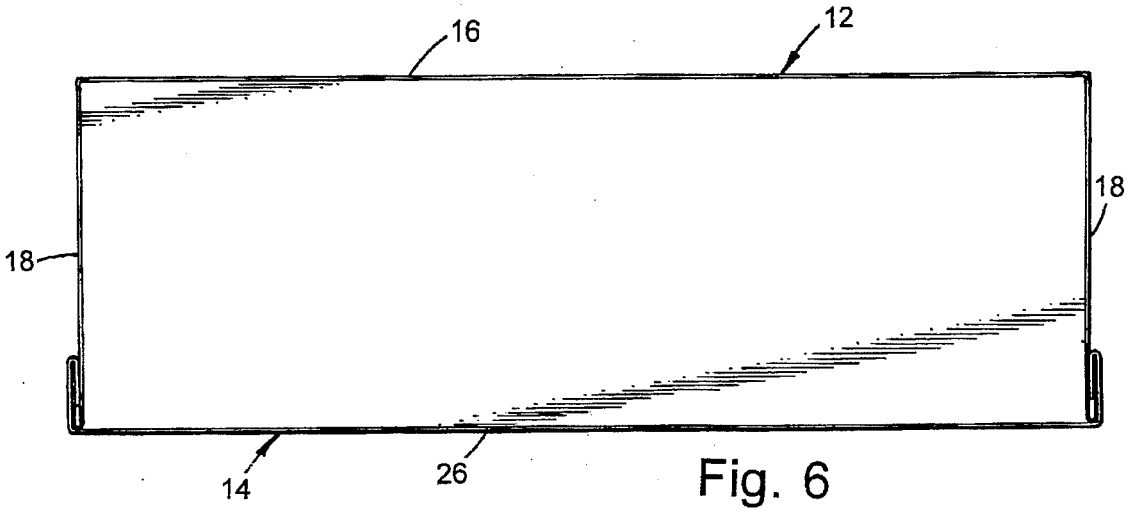
FIG. 6 is a sectional view through the center of the connector in FIG. 1 showing the slidably interconnected edges.
Figure 7:
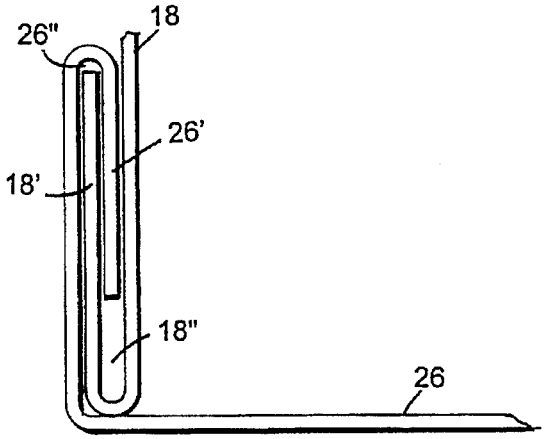
FIG. 7 is an enlarged, fragmentary, sectional view of the left slidably interconnected lateral edges of the components in FIGS. 1–6, this embodiment having the interengaged edges external of the connector walls.

One wall, i.e., the fourth wall 26, of duct connector 10 is formed by component 14 comprising a partial duct element to form this wall 26 (FIG. 6). The pair of free, parallel, opposite, elongated edges of this wall 26 are formed into a U-shaped configuration normal to the plane of wall 26, to each form a flange 26' and a groove 26" (FIG. 7) both perpendicular to the wall 26. Wall 26 is basically of the same width as wall 16 so that the cross sectional configuration of the resulting duct connector is preferably rectangular with wider walls 16 and 26 opposite and parallel to each other, and narrower walls 18 opposite and parallel to each other. Other cross sectional configurations can also be made, if desired. Elongated flange 18' and groove 18' of component 12 axially slidably interfit with groove 26" and flange 26' of component 14, respectively, to allow selected, incremental variable telescopic sliding movement of the components. Component 14 has an end flange forming end wall 28 normal to wall 26, to form a closure at this end of the connector. Closely adjacent end wall 28 is a circular opening 30 in wall 26 around which is mounted a cylindrical swivel sleeve 32 by a conventional crimped swivel connection to wall 26. Sleeve 32 projects laterally to be normal to wall 26. Hence, sleeves 24 and 32 both project perpendicularly to the elongated axis of connector 10, in opposite directions to each other but parallel to each other. Therefore, one sleeve can be connected to a dryer outlet and the other sleeve to a wall outlet opening for flow of discharge air into one sleeve, through the connector, and out the other sleeve. It is important that there is no significant dead air space beyond either sleeve, i.e., between the opening and the end wall, to collect significant amounts of lint for a potential fire hazard. The connector can be infinitely variably telescopically contracted from the extended condition shown in FIG. 1, with the sleeves at maximum spacing several inches from each other, down to zero offset as shown in FIG. 4, i.e., with sleeves 24 and 32 aligned with each other. The maximum spacing is the length of the elements. The minimum spacing of the openings is actually zero, i.e., alignment of the openings. The minimum spacing is not dependent on the maximum length as is true of the prior art. When contracted to the minimum condition illustrated in FIG. 4, end wall 28 of component 14 moves within the confines of walls 18 and 16 of component 12 to cause the two end walls to close off the space beyond the openings 22 and 30. The connector can be any maximum length desired simply by manufacturing the partial duct elements of whatever length desired. This determines the maximum length of the connector. The minimum length is zero, regardless of the maximum length.

In the contracted condition illustrated in FIG. 4, the extended tail portions of components 12 and/or 14 may be easily trimmed off using a pair of tin snips or the like. Such trimming is easy to accomplish because neither one of the components constitutes a peripherally full enclosure, i.e., a tube, but rather has free edges for initiating the cut. In contrast, the tubular prior art components would be difficult to trim.

Figure 1B:
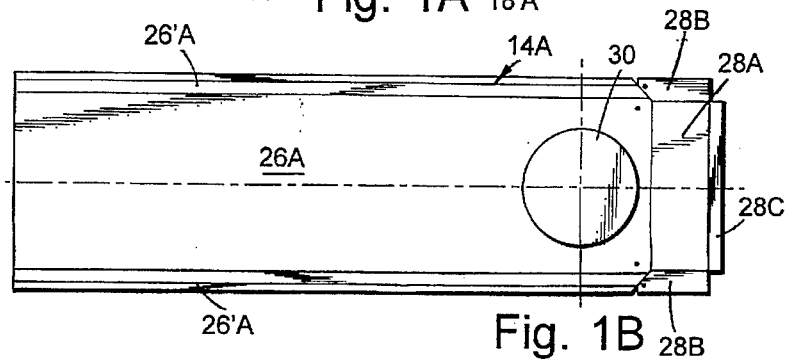
FIG. 1B is a plan view of a flat blank to form the lower component of the connector in FIG. 1.
Figure 1:
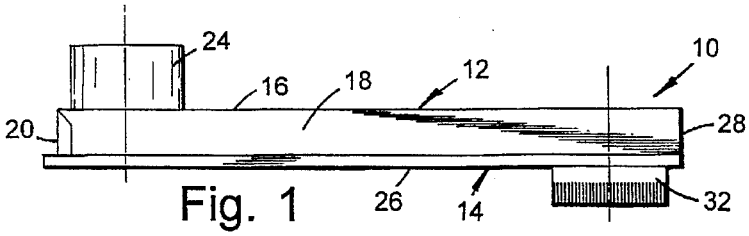
FIG. 1 is a side elevational view of a first embodiment connector of this invention, shown in its extended condition.
Figure 2:
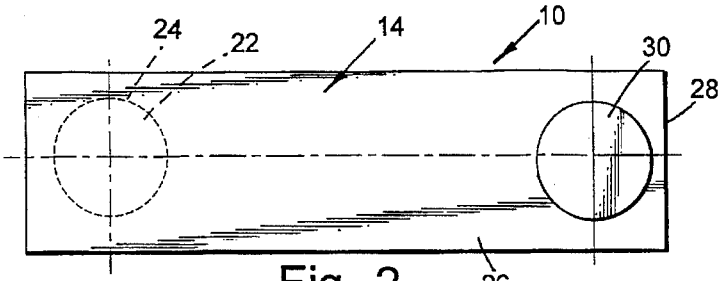
FIG. 2 is a bottom view of the duct connector in FIG. 1.
Figure 3:
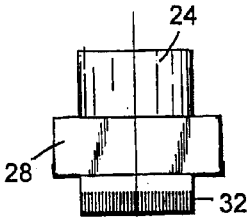
FIG. 3 is an end elevational view of the connector in FIGS. 1 and 2.

The two components 12 and 14 can be formed from the two blanks 12A and 14A depicted in FIGS. 1A and 1B. Thus, for component 12A, in its flat profile depicted, the central portion 16A will form wall 16, the side portions 18A will form walls 18, the outer edges of portions 18A, i.e., 18'A, will form the flanges 18', and end portion 20A will form end wall 20. The end portion 20A has a pair of opposite side edge flap portions 20B to be bent normal to portion 20A to lie against side walls 18 for riveting thereto through provided orifices to provide strength. End portion 20A also preferably has an end flap portion 20C to be bent normal to end portion 20A to lie against wall 26 in the completed connector. Similarly, as to component blank 14A, the central portion 26A will form wall 26, edge portions 26'A will form flanges 26', and end portion 28A will form end wall 28. End portion 28A has a pair of side edge flap portions 28B and an end flap portion 28C, all to be bent normal to portion 28A. The inner ends of portions 28B are orificed to be riveted to wall 26 for strength. Optionally, side edge flap portions 28B can be elongated as depicted in phantom in FIG. 5, for greater strength and stability of the partial duct element.

Second Embodiment

Figure 8:
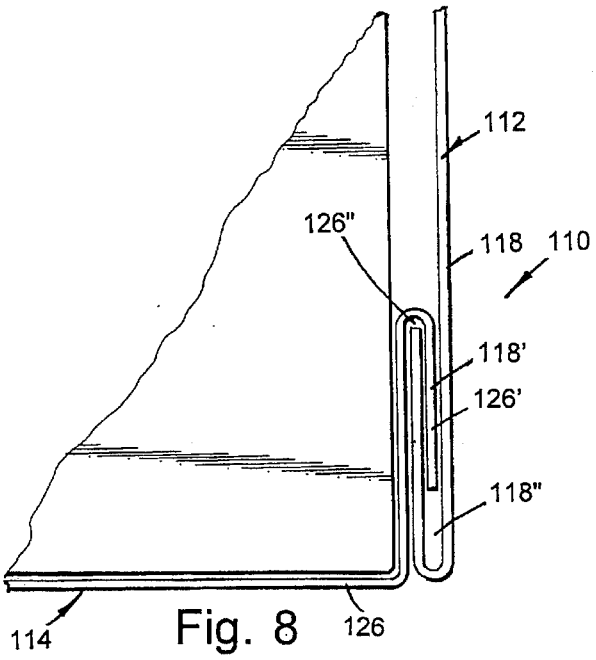
FIG. 8 is a fragmentary, enlarged, sectional view of the lower right edges of a second embodiment, having the slidably interconnected edges internal of the duct connector walls.
Figure 9:
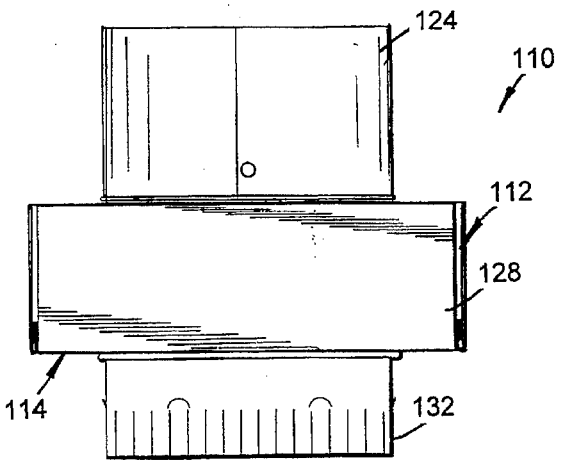
FIG. 9 is an end elevational view of the second embodiment.
Figure 10:
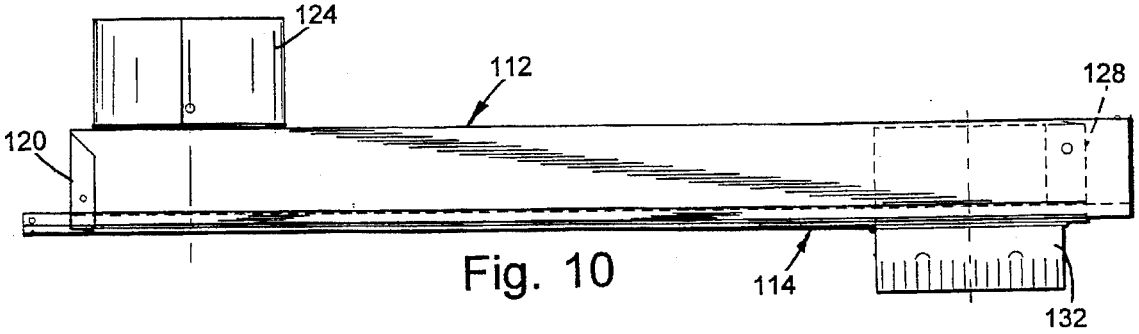
FIG. 10 is a side elevational view of the second embodiment.

Referring now specifically to FIGS. 8–10, the second embodiment 110 is similar to the first embodiment 10 except that the slidably interconnected edges between the two components 112 and 114 are internal of the resulting connector structure. More specifically, a U-shaped edge flange 118' extends inwardly, parallel to each wall 118, to form an internal groove 118", this groove receiving the outwardly extending flange 126' while flange 118' is received in groove 126". The opposite edges of wall 126 are bent normal to wall 126, inwardly of the connector, and then in a U-shape back in the opposite direction to result in outer flange 126' and groove 126". As in the first embodiment, a cylindrical, laterally extending swivel sleeve 124 is mounted around a circular opening located closely adjacent end wall 120 of component 112. A second swivel sleeve 132 is mounted around a circular opening closely adjacent the opposite end wall 128 of component 114. These sleeves extend in opposite directions, both normal to the main dimension of the elongated connector, and parallel to each other.

This second embodiment, like the first embodiment, can be extended to a maximum spacing between the like sleeves 124 and 132 and their respective openings, to the length of the partial duct elements, or contracted infinitely variably down to a zero offset position between these openings. Here again, the minimum spacing of the openings is independent of the maximum spacing.

Third Embodiment

Figure 11:
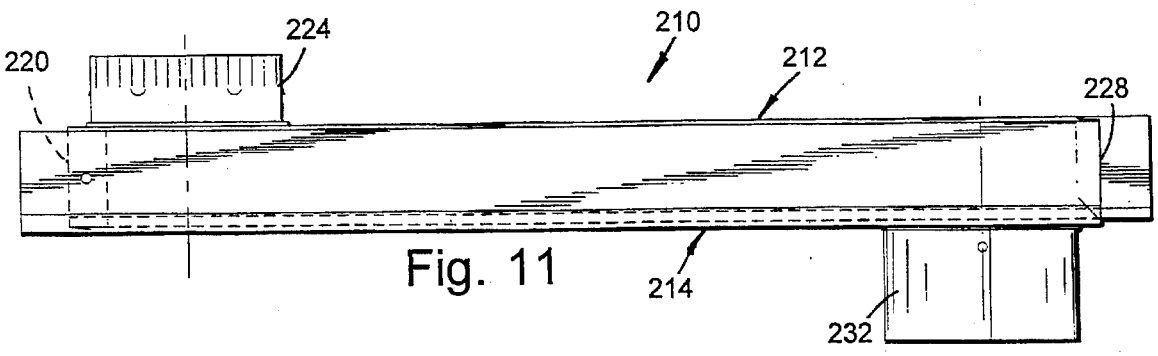
FIG. 11 is a side elevational view of a third embodiment of the invention formed of two like partial components slidably interconnected at diagonally opposite corners.
Figure 12:
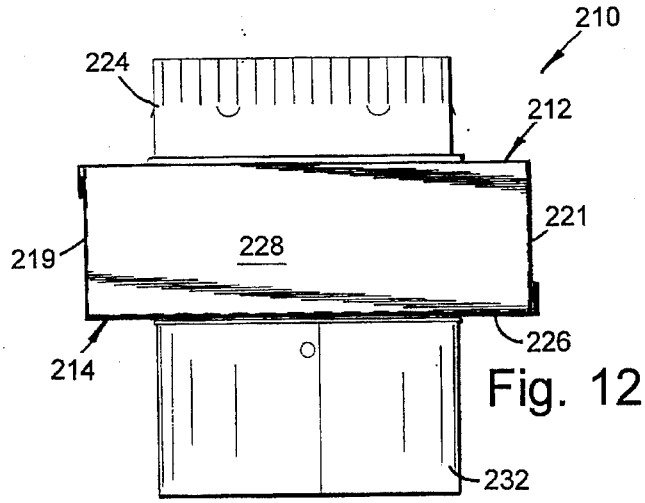
FIG. 12 is a left end elevational view of this third embodiment in FIG. 11.
Figure 13:
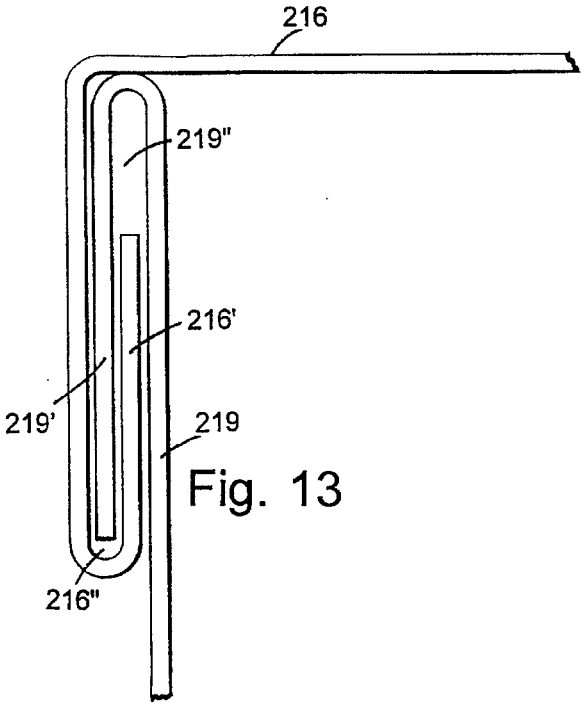
FIG. 13 is an enlarged, fragmentary, sectional view of a portion of the upper left interconnected lateral edges of this third embodiment of FIG. 12.

In FIGS. 11–13 is a third embodiment 210 wherein the upper element 212, instead of having three walls, has two walls perpendicular to each other in a generally L-shaped integral configuration, while the lower element 214, instead of having one wall, has two walls perpendicular to each other in a generally L-shaped configuration. Both elements are alike. Each element preferably, but not necessarily, has a narrower wall and a wider wall. The free edges of the two narrower walls, and the free edges of the two wider walls, have a U-shaped configuration to form flanges and grooves which slidably interconnect with each other. More specifically, the free edges of each of the wider walls 216 of elements 212 and 214 are bent normal to the plane of walls 216 and then into a U-shaped configuration to form flanges 216' and adjacent, parallel grooves 216". The free edges of each of the narrower side walls 219 and 221 of the respective components 214 and 212 have a U-shaped configuration with flanges 219' parallel to walls 219 and forming grooves 219" therebetween. Thus, the sliding interconnections between the free edge of wall 221 and wall 226 are configurated like those FIG. 13, but inverted. Partial duct element 212 includes an end wall 220 with a closely adjacent circular opening surrounded by a cylindrical swivel sleeve 224 attached to wall 216. Partial duct element 214 has an end wall 228, opposite end wall 220, and a closely adjacent circular opening surrounded by cylindrical swivel sleeve 232 attached to wall 226. The two narrower walls are opposite each other, and the two wider walls are opposite each other.

An advantage of this particular structure is that the two partial duct elements 212 and 214 are alike such that the same machinery forming one element can be used for forming the other element. The structure can be extended and contracted between the full length depicted in FIG. 11, i.e., basically the length of the partial duct elements, and any of incrementally varying positions between that and actual alignment of the openings and swivels, i.e., zero displacement therebetween.

Fourth Embodiment

Figure 14A:
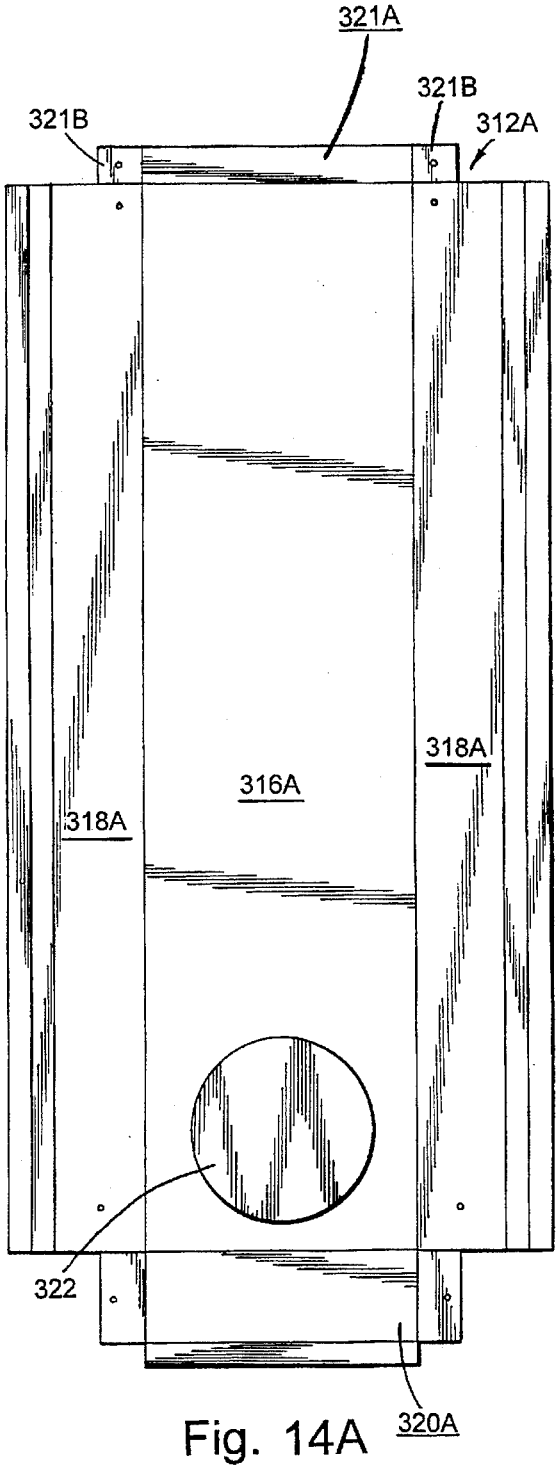
FIG. 14A is a plan view of the flat blank for forming the bottom one of the components of the fourth embodiment in FIG. 16.
Figure 14B:
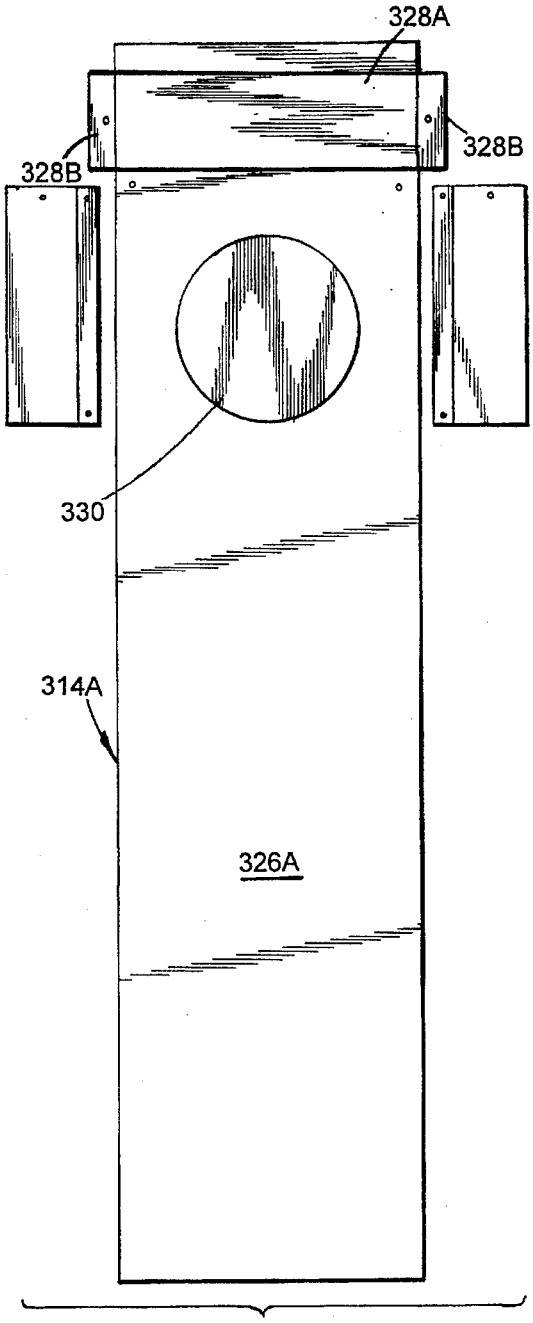
FIG. 14B is a plan view of the flat blank of the other component of the fourth embodiment, this flat blank retaining its flat nature in its use.
Figure 14:
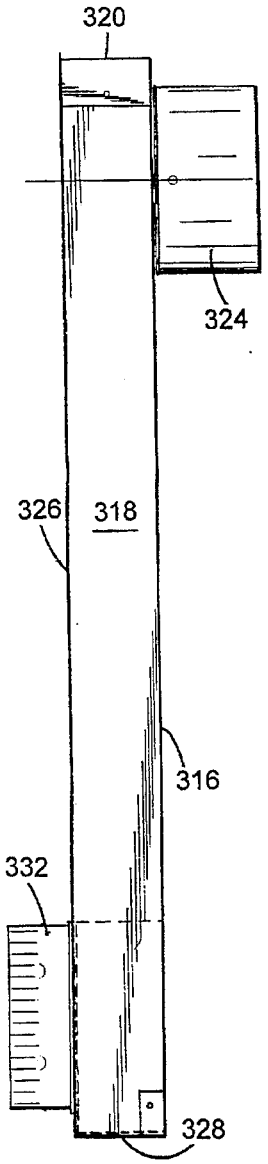
FIG. 14 is a side elevational view of a fourth embodiment.
Figure 15:
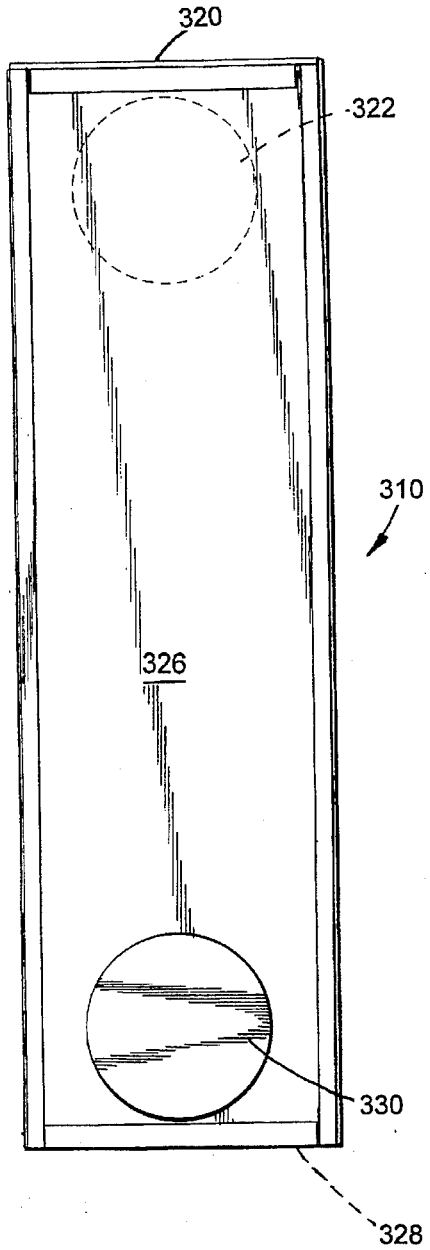
FIG. 15 is an elevational view of the left side of the structure in FIG. 14.
Figure 16:
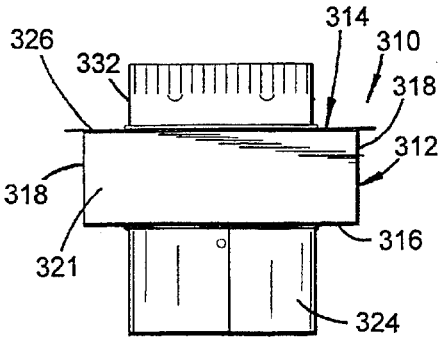
FIG. 16 is an end elevational view of the fourth embodiment.
Figure 17:
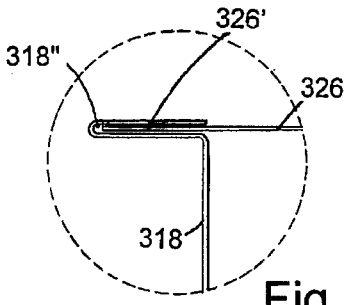
FIG. 17 is a fragmentary, enlarged, sectional view of the left sliding interconnected edges of the connector in FIG. 16.

Referring now to FIGS. 14–17, the fourth embodiment is there depicted. Here, as with the first and second embodiments, partial duct element 312 of this connector 310 has three side walls, i.e., shown to have one wide wall and two narrow walls parallel to each other and integrally connected to and bent normal to the wider wall. Partial duct element 314 has a single wall with a pair of opposite free side edges slidably interconnected with the free U-shaped edges of the narrow walls of element 312. Element 312 has an end wall 328 normal to wall 326 and opposite end wall 320. Element 312 has a cylindrical opening closely adjacent its end wall 320, there being a cylindrical swivel sleeve 324 around this opening and connected to wall 316 immediately adjacent end wall 320. Similarly, element 314 has a lateral circular opening 330 closely adjacent its end wail 328, and a cylindrical sleeve 332 around opening 330, connected to wall 326. These sleeves extend normal to walls 316 and 326, parallel to each other. With this connector, only one of the components has U-shaped edges, namely component 312, by having its side walls 318 extending outwardly perpendicular to wall 318 to form grooves 318", with the lateral side edges 326' of flat wall 326 extending into grooves 318' (FIG. 17). Wall 326 is formed from the blank 326A (FIG. 14B) having opening 330. Element 312 is formed from the blank 312A (FIG. 14A) with the central portion 316A to form the wide center wall, side portions 318A to form the two narrow walls straddling the center wall, and free edge portions to form the U-shaped grooves 318'. Blank 312A has an end flap 321A with opposite side edge flaps 321B thereon to be bent for riveted connection to side walls 318 for stability and strength. Element blank 314A has end portion 328A to form end wall 328, which has side edge flap portions 328B to lie against side walls 318 for stability.

In use, the two elements are slidably interconnected, the distance between the centerlines of the sleeves is slidably adjusted to that necessary to fit with the dryer outlet and the wall outlet and, if necessary or desirable, the free overlapping end flap of element 314 is cut off.

Those skilled in this art might modify the particular preferred embodiments set forth herein as exemplary, to suit a particular situation. For example, the four walls of the connector could conceivably be formed of four elements, two of which have lateral openings. Also, the three sided and one sided partial duct elements could be slidably connected with inside or outside flanges and grooves which are alongside and parallel to the walls as in FIG. 6, or out and away from, i.e., perpendicular to, the walls as in FIG. 16. Alternatively, the two, two sided partial duct elements could have the sliding flanges and grooves out and away from the walls, or lying alongside the walls, either inside the resulting connector or outside the resulting connector. The invention is not intended to be limited to the specific embodiments set forth as illustrative and preferred, but only by the scope of the appended claims and the equivalents thereto.

The embodiments of the invention in which an exclusive property or privilege is claimed are defined as follows:

1. An extensible-contractible duct connector comprising slidingly interfittable, elongated, partial duct elements;

opposite partial duct elements telescopically interfitted to cooperatively form a duct connector;

said opposite partial duct elements each having a closed end and having a lateral air flow opening closely adjacent said closed end to prevent significant dead air space between each said opening and the adjacent closed end;

said partial duct elements having slidably interfitting edges with each other enabling sliding telescopic interfit that is incrementally variably adjustable to a selected position between a maximum extended condition with said lateral air flow openings offset maximally from each other, and a contracted condition with said lateral air flow openings having zero offset from each other.

2. The duct connector in claim 1 wherein said partial duct elements have slidably interconnected edges to create the selected offset between said lateral air flow openings.

3. The duct connector in claim 2 wherein said edges have interconnected flanges and grooves.

4. The duct connector in claim 3 comprising two partial duct elements, one of said partial duct elements having three sides and the other of said partial duct elements having one side.

5. The duct connector in claim 3 wherein one of said partial duct elements has two sides and the other of said partial duct elements has two sides.

6. The duct connector in claim 5 wherein said two sides of each partial duct element comprise one narrower side and one wider side, the two narrower sides being opposite each other and the two wider sides being opposite each other.

7. The duct connector in claim 3 wherein said edges are U-shaped to form said interconnecting flanges and grooves.

8. The duct connector in claim 7 wherein said flanges and grooves are external of said duct connector.

9. The duct connector in claim 8 wherein said flanges and grooves lie alongside the walls of said duct connector.

10. The duct connector in claim 8 wherein said flanges and grooves project away from said duct connector.

11. The duct connector in claim 7 wherein said flanges and grooves are internal of said duct connector.

12. The duct connector in claim 11 wherein said flanges and grooves lie alongside the walls of said duct connector.

13. An extensible-contractible duct connector comprising first and second slidingly interfittable, elongated, partial duct elements;

each partial duct element having one open end telescopically interfit with one open end of the other partial duct element to cooperatively form a duct connector, and having an outer closed end;

each partial duct element having a lateral air flow opening closely adjacent the respective one of said closed ends to prevent significant dead air space between said opening and said adjacent closed end;

said partial duct elements having slidably elongated edges interfitting with each other enabling sliding telescopic interfit that is selectively variably adjustable between an extended condition with said lateral air flow openings offset maximally from each other, and a contracted condition with said side air flow openings having zero offset from each other.

14. The duct connector in claim 13 wherein said partial duct elements have slidably interconnected edges to create a selected adjustable offset between said lateral air flow openings.

15. The duct connector in claim 14 wherein said edges have interfitting flanges and grooves.

16. The duct connector in claim 15 wherein one of said partial duct elements has three sides and the other of said partial duct elements has one side.

17. The duct connector in claim 16 wherein the edges of at least one of said partial duct elements are U-shaped to form grooves that receive flanges of said other partial duct element.

18. The duct connector in claim 17 wherein said edges and grooves of said one duct element project away from said connector.

19. The duct connector in claim 17 wherein said edges and grooves are internal of said duct connection.

20. The duct connector in claim 17 wherein said edges and grooves are external of said duct connection.

* * * * *